US007578241B2

(12) United States Patent
Hjort

(10) Patent No.: US 7,578,241 B2
(45) **Date of Patent: *Aug. 25, 2009**

(54) TELESCOPIC RAIL AND CARRIAGE ASSEMBLY FOR SUSPENDING A PATIENT LIFT

(75) Inventor: Mogens Hjort, Korsor (DK)

(73) Assignee: Ergolet A/S, Korsor (DK)

( * ) Notice: Subject to any disclaimer, the term of this patent is extended or adjusted under 35 U.S.C. 154(b) by 0 days.

This patent is subject to a terminal disclaimer.

(21) Appl. No.: 12/175,984

(22) Filed: Jul. 18, 2008

(65) Prior Publication Data

US 2008/0271242 A1 Nov. 6, 2008

Related U.S. Application Data

(63) Continuation of application No. 10/555,494, filed on Nov. 1, 2005, now Pat. No. 7,506,589.

(51) Int. Cl.
*E01B 23/00* (2006.01)

(52) U.S. Cl. ..... 104/126; 5/83.1; 212/312

(58) Field of Classification Search ..... 104/89, 104/93, 94, 126, 172.1; 105/155; 5/83.1, 5/87.1, 89.1; 212/312, 314, 315
See application file for complete search history.

(56) References Cited

U.S. PATENT DOCUMENTS 2,688,410 A * 9/1954 Nelson ..... 212/343
5,188,035 A 2/1993 Hideyuki
6,575,100 B2 * 6/2003 Faucher et al. ..... 104/126

FOREIGN PATENT DOCUMENTS

WO WO01/74285 10/2001

* cited by examiner

*Primary Examiner*—Lars A Olson
(74) *Attorney, Agent, or Firm*—Niky E. Syrengelas, Esq.; Crockett & Crockett

(57) ABSTRACT

A telescopic rail and carriage assembly for suspending a patient lift. The carriage has a downward projection to which the patient lift is to be connected. The telescopic rail has an inner rail section and an outer rail section. The outer rail section is provided with first longitudinally extending interior support surfaces for supporting a lower set of wheels of the carriage. The inner rail section is provided with second longitudinally extending interior support surfaces for guiding and supporting an upper set of wheels of the carriage. In the extended state, the carriage is guided by the either the first or the second longitudinally extending support surfaces except where the first and second rail sections overlap. In the overlap, the wheels of the carriage are supported by both the first and second longitudinally extending interior support surfaces. A support structure for suspending a patient lift, having a telescopic rail provided with a carriage with means for attaching the patient lift thereto, a pair of upstanding pole components each provided with a stabilizing ground support. The opposite ends of the telescopic rail are connected to the upper ends of the upstanding pole components.

10 Claims, 6 Drawing Sheets

TELESCOPIC RAIL AND CARRIAGE ASSEMBLY FOR SUSPENDING A PATIENT LIFT

This application is a continuation of U.S. application Ser. No. 10/555,494 filed Nov. 1, 2005 now U.S. Pat. No. 7,506,589, which claims priority to PCT/EP2004/005027 filed May 11, 2004, which claims priority to EP 030 10 894.8 filed May 15, 2003.

FIELD OF THE INVENTION

The present invention relates to a telescopic rail and carriage assembly for suspending a patient lift. Such telescopic rails are typically used as an overhead rail on a support structure or frame. A winch can be attached to the carriage and a lifting belt or the like can be suspended from the extendable cable or strap of the winch so as to be able to raise and lower a patient. The support structure itself may comprise two telescopic rails, whereby the telescopic rail that carries the patient lift is attached with its opposing ends to the respective carriages of the two telescopic rails of the support structure. Such support structures are particularly easy to be assembled, adjusted and disassembled again, thus allowing the installation of an overhead rail in a short time and without the need of anchoring into ceilings or walls.

BACKGROUND OF THE INVENTIONS

WO 01/74285 discloses a telescopic rail and carriage assembly comprising an inner rail section and an outer rail section. The inner rail section is partially received within the outer rail section so as to be telescopically displaceable in and out of the outer rail section. The outer rail section has a longitudinally extending first opening through which a trolley connector projection may extend. The first opening of the outer rail section is defined by opposed inwardly extending slot projections extending into the interior side of the outer rail section. Each of the slot projections terminates in a respective first interior support surface. The inner rail section has a longitudinally extending second opening through which the trolley connector projection may extend. The inner rail section has interior surface portions bordering the second opening on opposite sides thereof defining respective second interior support surfaces. The slot projections are configured to register within the second opening such that the first and second interior support surfaces are in an essentially common plane and define a travel support surface for the trolley component. This construction allows the trolley to travel on the support surfaces provided by the outer rail section or the inner rail section or both. The rail construction is though not particularly stable, and therefore, less suitable for carrying heavy loads.

WO 01/74285 also discloses a support structure including the telescopic rail. The rail is supported by upstanding pole components that are tensioned between the floor and the ceiling of the room where the support structure is to be used.

SUMMARY

Against this background, it is an object of the present invention to provide telescopic rail and carriage assembly of the kind referred to initially, which can carry higher loads. This object is achieved in accordance with claim 1 by a telescopic rail and carriage assembly for suspending a patient lift, the carriage comprises a downward projection to which the patient lift is to be connected, at least one upper set of wheels and at least one lower set of wheels on vertically displaced axes that are interconnected with a connecting member, the telescopic rail comprises an inner rail section and an outer rail section, the outer rail section defining a first inner cavity, the inner rail section defining a second inner cavity, the inner rail section being at least partially disposed within the first cavity whereby the outer rail section embraces the inner rail section in a sliding engagement allowing the inner rail section to be telescopically displaceable in and out of the outer rail section, the outer rail section is provided with a first longitudinally extending opening through which the downward projection of the carriage may extend, the inner rail section is provided with a second longitudinally extending opening through which the connecting member may extend, the outer rail section is provided with a first longitudinally extending interior support surface on both sides of the first longitudinally extending opening for guiding an supporting the lower set of wheels, and the inner rail section is provided with a second longitudinally extending interior support surface on both sides of the second longitudinally extending opening for guiding and supporting the upper set of wheels.

The resulting profile of the rail is relatively high and narrow, and therefore its capacity to resist bending under vertical loads is higher than a comparable profile which is not as high. The profile according to the invention can therefore with the same compactness as the prior art profiles carry heavier loads.

The upper set of wheels may comprise four wheels on two longitudinally spaced axes. The lower set of wheels may comprise four wheels on two longitudinally spaced axes.

The telescopic rail and carriage assembly may comprise two inner sections coupled by an outer section. Thus, the span of the telescopic rail can be increased.

Preferably, the distance between the first support surfaces and the second support surfaces is substantially equal to the distance between the underside of the lower wheels and the underside of the upper wheels. Thus, a smooth transition of the carriage between the first and second support surfaces is possible.

The rail sections are preferably extruded aluminum profiles with a substantially C-shaped cross-section.

It is another object of the invention to provide a support structure for suspending a patient lift that is easier to set up and knock down than the above referenced prior art construction. This object is achieved in accordance with claim 6 by providing a support structure for suspending a patient lift, comprising a telescopic rail provided with a carriage with means for attaching the patient lift thereto, and a pair of upstanding pole components each provided with a stabilizing ground support. The opposite ends of the telescopic rail are connected to the upper ends of the upstanding pole components.

Thus, a versatile support structure is provided that can be set up quickly in a room without the need for any contact with the walls or ceiling of the room.

The stabilizing ground support can be a bar extending transversely to the telescopic rail in two opposite directions from the upstanding pole components, preferably at its ends provided with castors or the like. Thus, it is easy to set up the upstanding pole components. With the castors it is easy to move the support structure.

The height of each of the upstanding pole components can be adjustable, preferably through a telescopic construction.

The telescopic rail may comprise an inner rail section and an outer rail section, the outer rail section embraces the inner rail section in a sliding engagement allowing the inner rail section to be telescopically displaceable in and out of the outer rail section, and each of the rail sections defines a pair of longitudinally extending interior support surfaces, either one above the other, or in a common plane.

It is another object of the invention to provide a support structure for suspending a patient lift that is more versatile than the above referenced prior art construction. This object is achieved in accordance with claim 11 by providing a support structure for suspending a patient lift, comprising two pairs of upstanding pole components, three telescopic rails, each provided with a carriage with means for attaching a load thereto, connecting means connecting the opposite ends of two of the telescopic rails to the respective pairs of upstanding pole components. The opposing ends of the third telescopic rail are suspended from the carriages in the other two rails.

Thus, an easy to adjust, set up an knock down support structure is provided that gives the patient lift two degrees of freedom in the horizontal plane.

Each of the upstanding pole components can be provided with adjustable members for keeping a distance to wall structures. The height of each of the upstanding pole components can be adjustable, preferably through a telescopic construction.

The support structure can further be provided with two telescopic stabilizing rods extending between the opposite upper corners of the pairs of upstanding pole components connected by the respective telescopic rails to improve the rigidity of the structure.

The telescopic rail for the support structure may comprise an inner rail section and an outer rail section, the outer rail section embraces the inner rail section in a sliding engagement allowing the inner rail section to be telescopically displaceable in and out of the outer rail section, and each of the rail sections defines a pair of longitudinally extending interior support surfaces, either one above the other, or in a common plane.

Further objects, features, advantages and properties of the telescopic rail and carriage assembly and the support structure, according to the invention will become apparent from the detailed description.

BRIEF DESCRIPTION OF THE DRAWINGS

In the following detailed portion of the present description, the invention will be explained in more detail with reference to the exemplary embodiments shown in the drawings, in which.

DETAILED DESCRIPTION OF THE INVENTIONS

Figure 1:
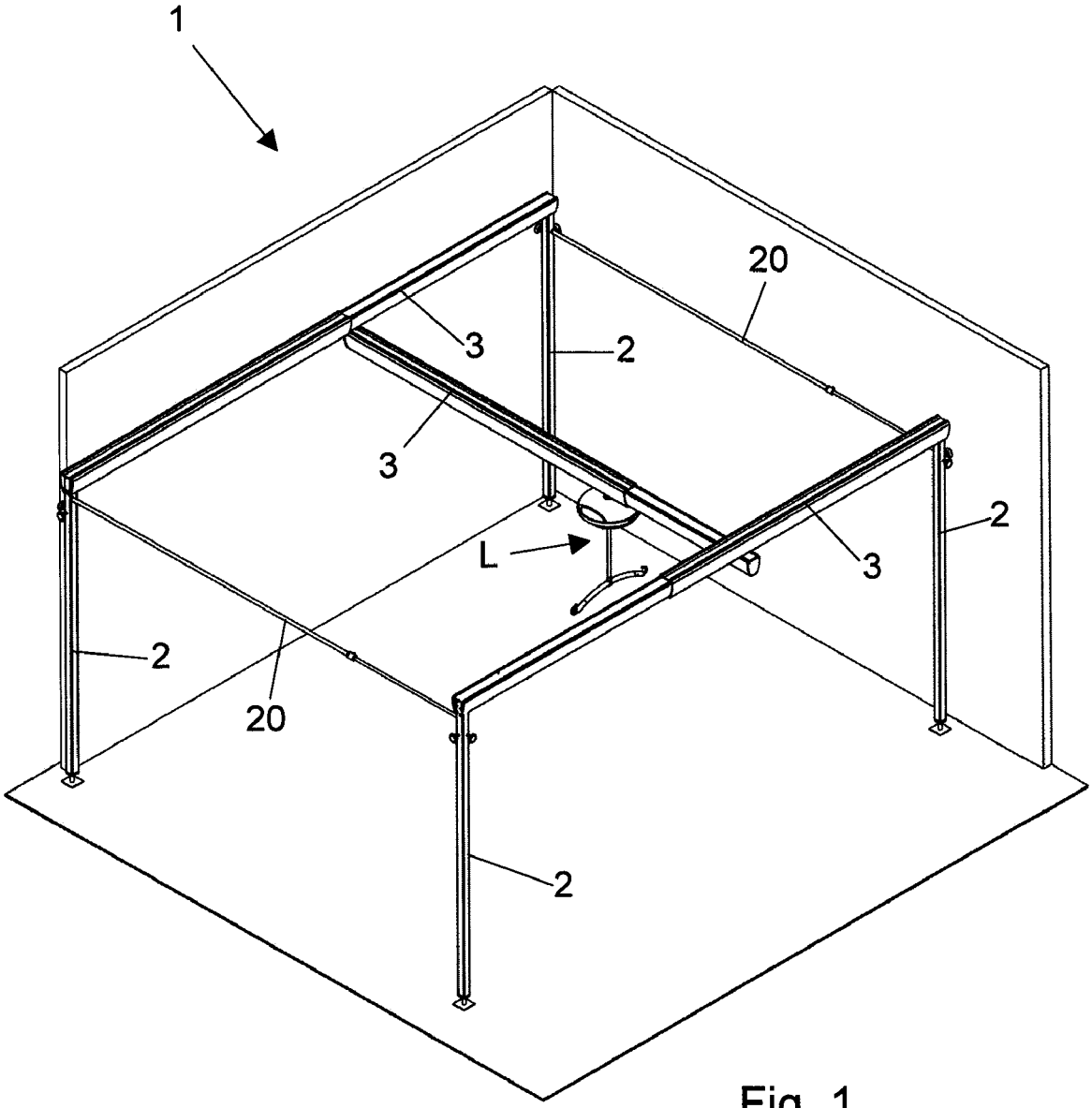
FIG. 1 shows an elevated view on a support structure for suspending a patient lift according to a preferred embodiment of the invention.

FIG. 1 illustrates a preferred embodiment of a support structure. The support structure 1 comprises two pairs of upstanding poles 2 of variable length. The top of the poles of each pair are connected to the opposite ends of a telescopic rail 3, also of variable length. The opposite ends of a third telescopic rail 3 are connected to the carriages in the other two telescopic rails 3. A patient lift L with or without a winch is suspended from the carriage in the third telescopic rail. Two telescopic stabilizing rods 20 extend between the corners where the telescopic rails 3 are connected to the upstanding poles 2. The stabilizing rods comprise an inner tube slidably received in an outer tube. The inner tube can be locked relative to the outer tube at a plurality of discrete positions by spring loaded locking pins (not shown) cooperating with corresponding openings the tubes. One end of the telescopic stabilizing rod is suited for fine adjustment in length by an end member (not shown) in threaded relation with the rod. These length adjusting constructions are well known in the art and are therefore not described in further detail here.

Figure 2:
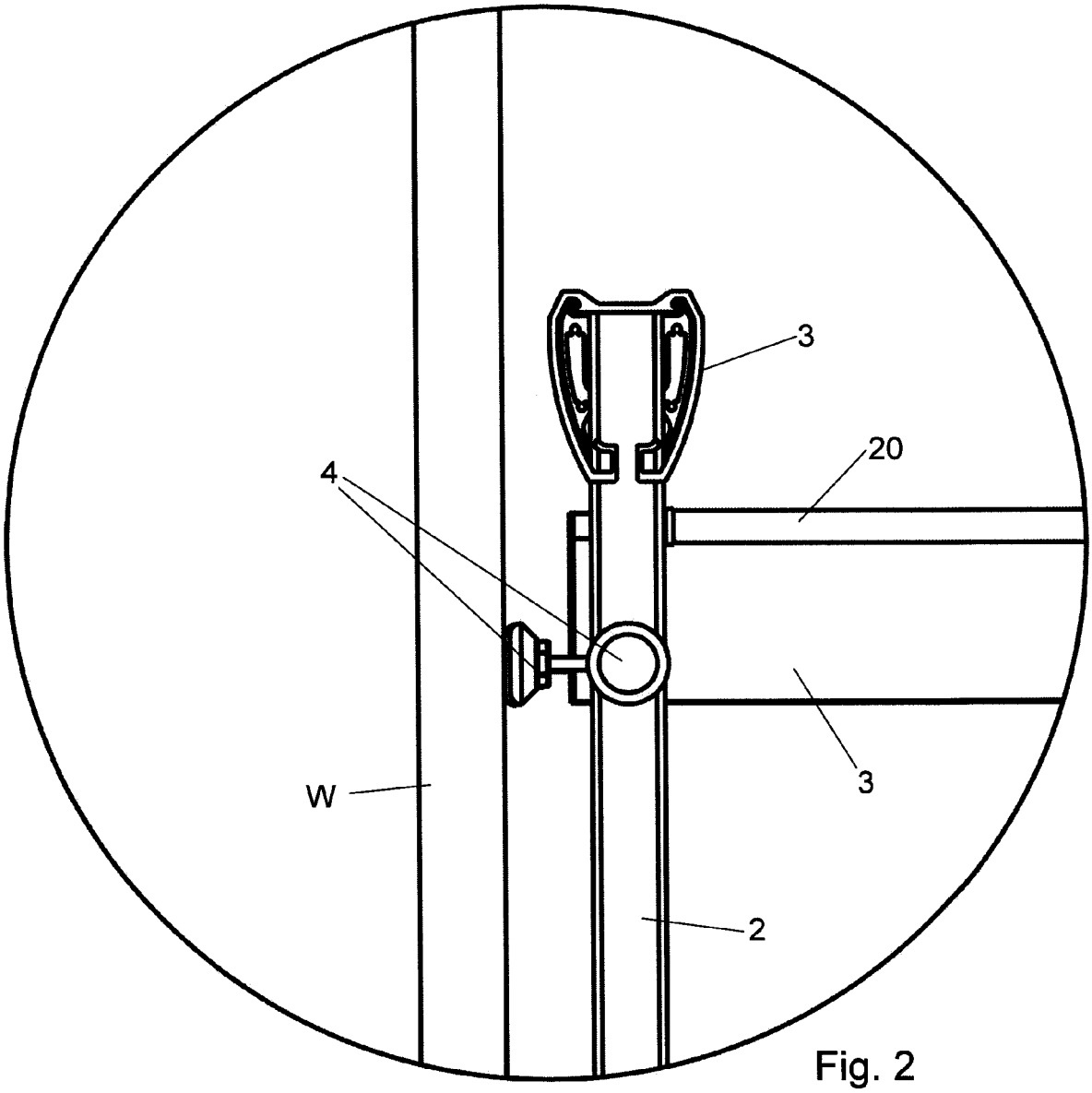
FIGS. 2 and 2*a* show details of the support structure of FIG. 1.
Figure 2A:
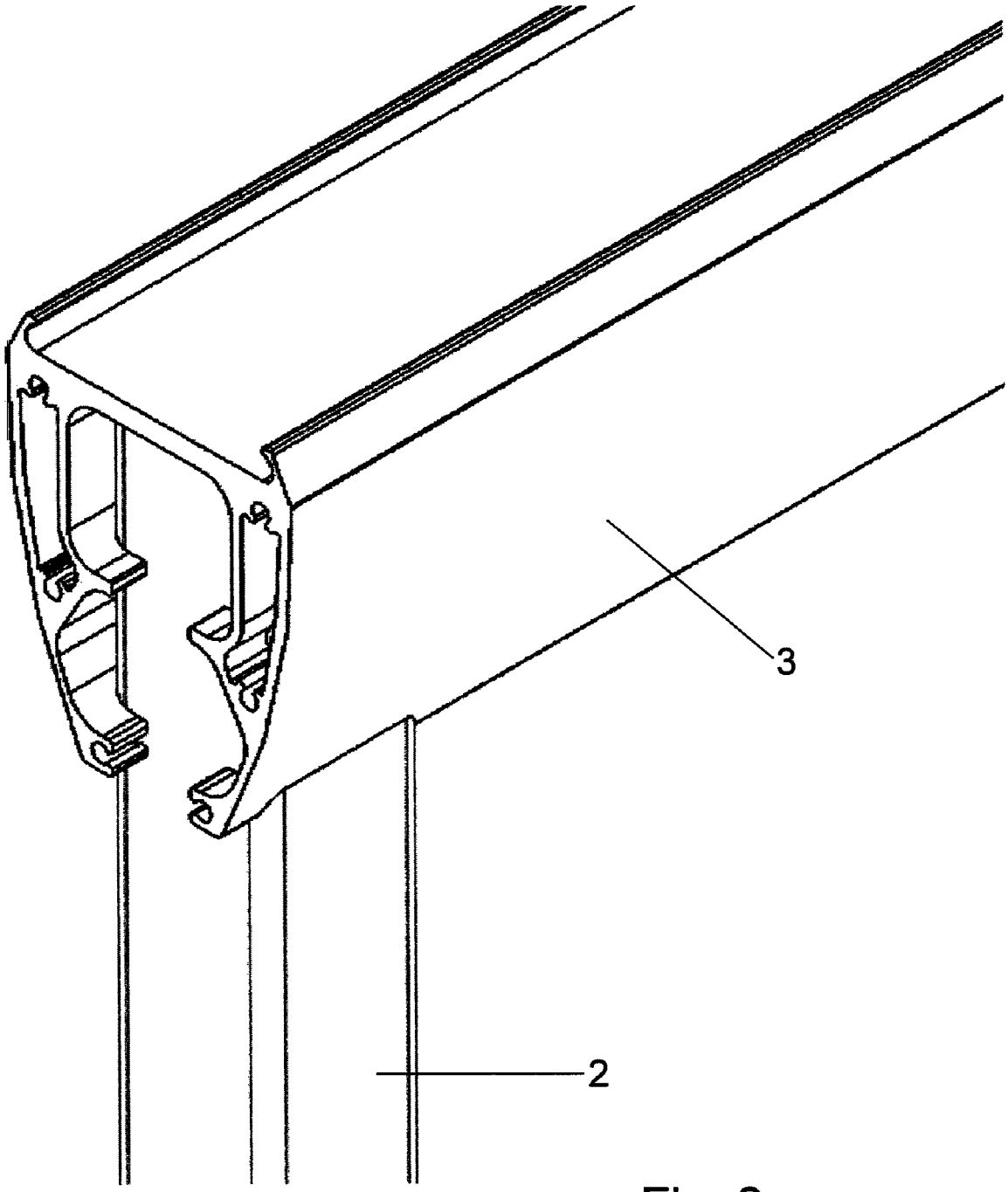

Referring to FIG. 2, the poles 2 are provided with adjustable distance keepers 4 for maintaining distance to the walls W of a building structure in which the support structure is placed. The end cap of the telescopic rail 3 is hidden in FIGS. 2 and 2*a* to show that the upstanding pole 2 is clamped inside the profiles of the telescopic rail members to obtain a stable connection between these elements.

Figure 2B:
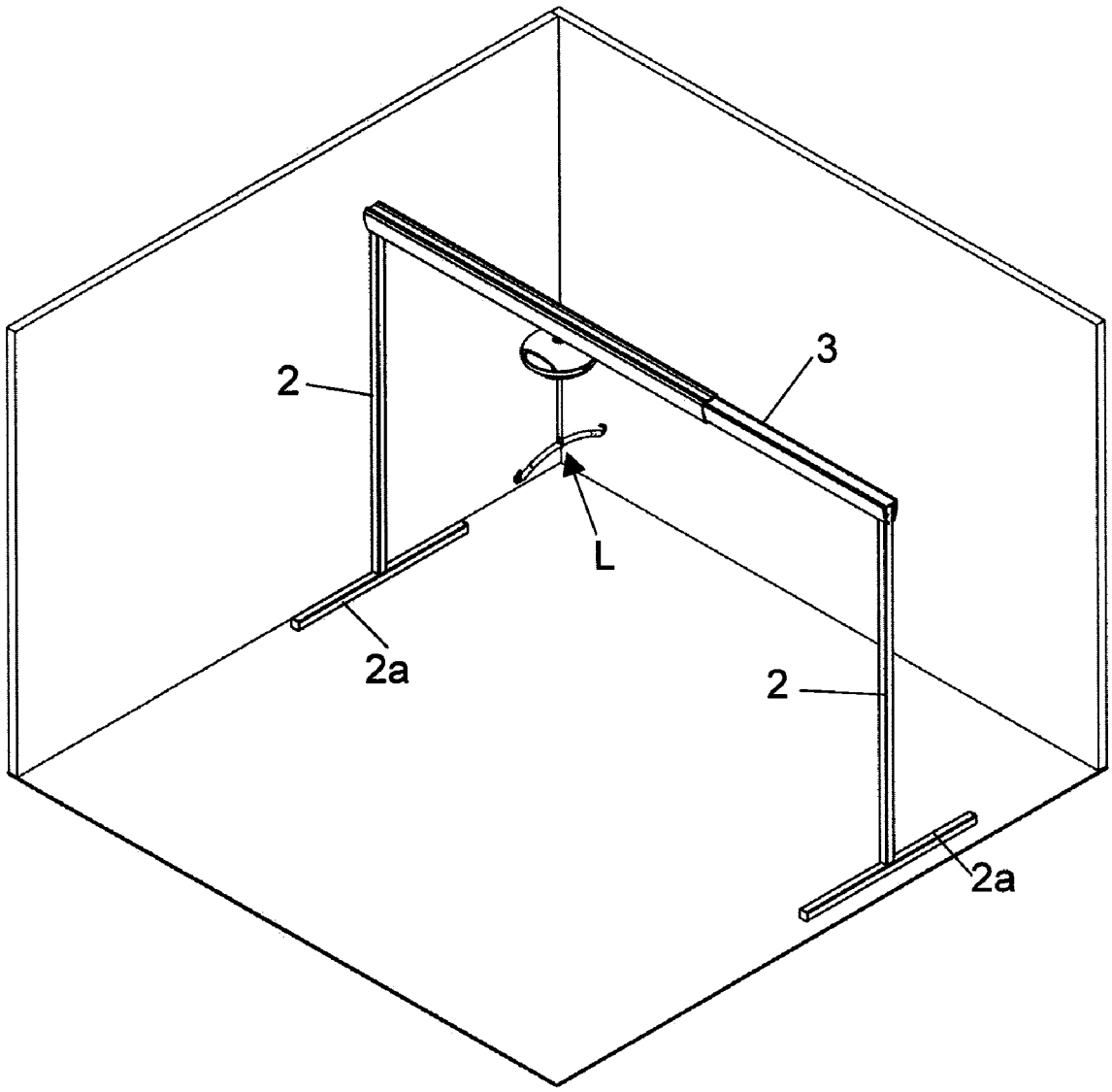
FIG. 2*b* shows an elevated view on a support structure for suspending a patient lift according to another preferred embodiment of the invention.

FIG. 2*b* shows another preferred embodiment of the support structure. This support structure comprises the same a telescopic rail 3 provided with a carriage with means for attaching the patient lift L thereto, as described for FIG. 1 and will be described in more detail below. The support structure comprises further a pair of upstanding pole components 2 each provided with a stabilizing bar 2*a* that extends transversely to the telescopic rail 3 in two opposite directions from the upstanding pole components 2. The stabilizing bar 2*a* can be provided with castors or the like at its ends to facilitate transportation of the support structure. The opposite ends of the telescopic rail 3 are connected to the upper ends of the upstanding poles 2.

Figure 3:
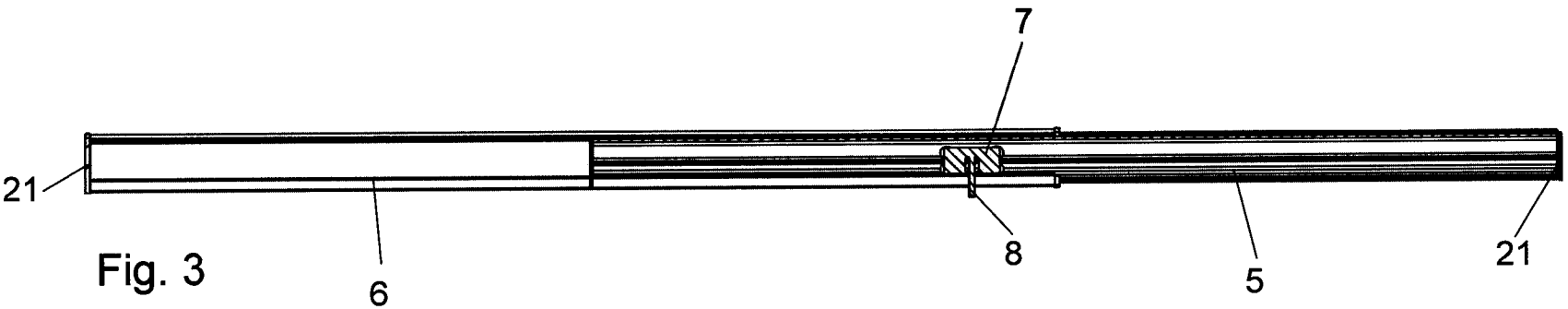
FIG. 3 shows a lengthwise sectional view through the telescopic rail according to the invention.
Figure 4:
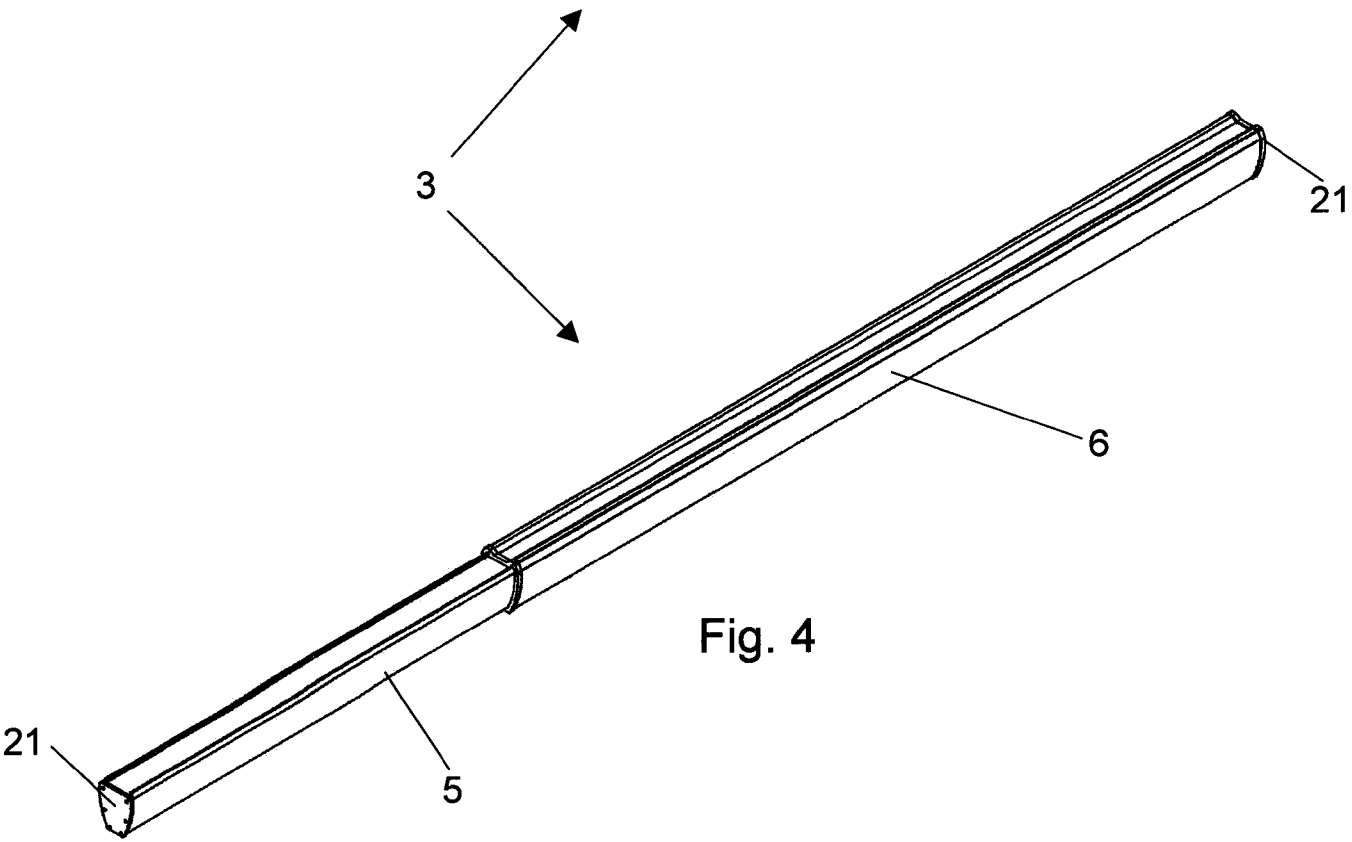
FIG. 4 shows and elevated view of the telescopic rail according to the invention.

FIGS. 3 and 4 show a preferred embodiment of the telescopic rail 3. The rail 3 comprises an inner rail section 5 and an outer rail section 6, preferably made from extruded aluminum profiles. The outer rail section 6 defines a first inner cavity. The inner rail section 5 defines a second inner cavity. The inner rail section 5 is at least partially disposed within the first cavity whereby the outer rail section 6 embraces the inner rail section 5 in a sliding engagement so as to be telescopically displaceable in and out of the outer rail section. Plastic or Teflon rail guides (not shown) are placed between the inner and outer rail parts at the end of the inner rail section 5 that is received in the outer rail section 6 and at the end of the outer rail section 6 where the inner rail section 5 enters. The rail guides position the rail sections at the correct distance from one another, allow for a smooth engagement and reduce backlash. The free ends of the rail sections 5,6 are closed by end caps 21.

A wheeled carriage 7 is received within the first and second cavities. The carriage 7 is provided with a downward projection 8 to which a patient lift is to be attached.

Figure 5:
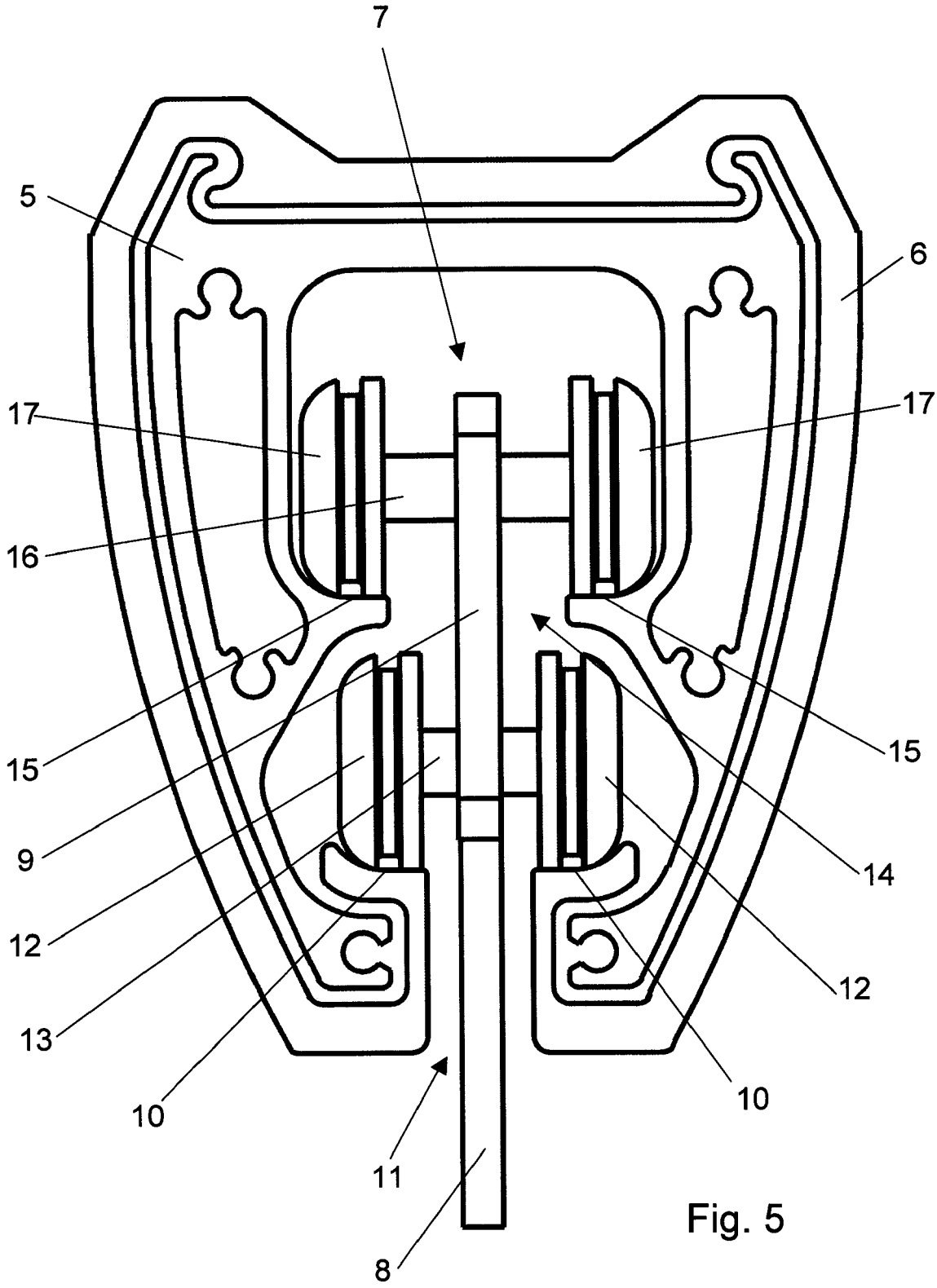
FIG. 5 shows an end view in detail of the telescopic rail according to the invention with the end caps removed.

As illustrated in FIG. 5 (end caps 21 are hidden to show the construction), the carriage comprises four upper wheels 17 on two upper axes 16 (only the foremost are visible in the figure). The carriage has further four lower wheels 12 on two lower axes 13. The upper and lower axes are connected to one another by a connecting plate 9. The connecting plate 9 has a downward extension that forms the downward projection 8.

The outer rail section 6 is provided with a first longitudinally extending opening 11 through which the downward projection 8 of the carriage 7 extends. The inner rail section 5 is provided with a second longitudinally extending opening 14 through which the connecting member 9 extends.

The first longitudinally extending opening 11 is defined by inwardly extending first slot projections extending into the first cavity. Each of the first slot projections defines a respective first longitudinally extending interior support surface 10 for guiding an supporting the lower wheels 12. The first support surface 10 extends over the full length of the outer rail section 6.

The second longitudinally extending 14 opening is defined by second inwardly extending slot projections extending into the second cavity. Each of the second slot projections defines a respective second longitudinally extending interior support surface 15 for guiding an supporting the upper wheels 17. The second support surface 15 extends over the full length of the inner rail section 5.

If the telescopic rail is in the retracted state (not shown) both the upper wheels 17 and the lower wheels 12 are guided by the respective support surface. Not all wheels are supported and simultaneously guided in an extended state of the telescopic rail 3.

The lower wheels 12 are guided by the first support surface 10, whilst the upper wheels 17 are not supported nor guided when the carriage 7 is located in a part of the telescopic rail 3 formed only by the outer rail section 6.

The upper wheels 17 are guided by the second support surface 15, whilst the lower wheels 12 are not supported nor guided when the carriage 7 is located in a part of the telescopic rail 3 formed only by the inner rail section 5.

Also in the extended state there is always a part of the telescopic rail 3 in which the inner and outer rail sections overlap. In this part of the telescopic rail 3 both the upper and lower wheels are supported and guided by the respective support surfaces.

The distance between the upper support surface 15 and the lower support surface 10 is substantially equal to the distance between the underside of the upper wheels 17 and the underside of the lower wheels 12. Thus, the carriage 7 may smoothly pass into and out of the part of the telescopic rail 3 in which the inner rail section 5 and the outer rail section 6 overlap one another.

The telescopic rail 3 can also comprise three or more rail sections, e.g. a telescopic rail comprising two inner sections coupled by an outer section (not shown).

Although the present invention has been described in detail for purpose of illustration, it is understood that such detail is solely for that purpose, and variations can be made therein by those skilled in the art without departing from the scope of the invention.

Thus, while the preferred embodiments of the devices and methods have been described in reference to the environment in which they were developed, they are merely illustrative of the principles of the inventions. Other embodiments and configurations may be devised without departing from the scope of the appended claims.

I claim:

1. A telescopic rail and carriage assembly for suspending a patient lift, wherein:

the carriage comprises a downward projection to which the patient lift is to be connected, at least one upper set of wheels and at least one lower set of wheels on vertically displaced axes that are interconnected with a connecting member, the telescopic rail comprises an inner rail section and an outer rail section, the outer rail section defining a first inner cavity, the inner rail section defining a second inner cavity, the inner rail section being at least partially disposed within the first cavity whereby the outer rail section embraces the inner rail section in a sliding engagement allowing the inner rail section to be telescopically displaceable in and out of the outer rail section, the outer rail section is provided with a longitudinally extending first opening through which the downward projection extends, the inner rail section is provided with a longitudinally extending second opening through which the connecting member extends, the outer rail section is provided with a first longitudinally extending interior support surface on both sides of the first longitudinally extending opening for guiding and supporting the lower set of wheels, and the inner rail section is provided with a second longitudinally extending interior support surface on both sides of the second longitudinally extending opening for guiding and supporting the upper set of wheels.

2. A telescopic rail and carriage assembly according to claim 1, wherein the upper set of wheels comprises four wheels on two longitudinally spaced axes, and the lower set of wheels comprises four wheels on two longitudinally spaced axes.

3. A telescopic rail and carriage assembly according to claim 1, comprising two inner sections coupled by an outer section.

4. A telescopic rail and carriage assembly according to claim 3, wherein the distance between the first support surfaces and the second support surfaces is substantially equal to the distance between the underside of the lower wheels and the underside of the upper wheels.

5. A telescopic rail and carriage assembly according to claim 3, wherein the rail sections are extruded aluminum profiles with a substantially C-shaped cross-section.

6. A support structure for suspending a patient lift, comprising:

a telescopic rail provided with a carriage with means for attaching the patient lift thereto, the telescopic rail comprising an inner rail section and an outer rail section, the outer rail section defining a first inner cavity, the inner rail section defining a second inner cavity, the inner rail section being at least partially disposed within the first cavity whereby the outer rail section embraces the inner rail section in a sliding engagement allowing the inner rail section to be telescopically displaceable in and out of the outer rail section, the outer rail section is provided with a longitudinally extending first opening through which the downward projection may extend, the inner rail section is provided with a longitudinally extending second opening through which the connecting member may extend, the outer rail section is provided with a first longitudinally extending interior support surface on both sides of the first longitudinally extending opening for guiding and supporting the lower set of wheels, and the inner rail section is provided with a second longitudinally extending interior support surface on both sides of the second longitudinally extending opening for guiding and supporting the upper set of wheels;

a pair of upstanding poles where the height of each upstanding pole is adjustable; and the opposite ends of the telescopic rail being connected to the upper ends of the upstanding poles.

7. A support structure for suspending a patient lift, comprising:

two pairs of upstanding poles;

three telescopic rails, each provided with a carriage with means for attaching a load thereto;

the opposite ends of two of the telescopic rails being connected to the respective pairs of upstanding pole components; and the opposing ends of the third telescopic rail being suspended from the carriages in the other two rails.

8. A support structure according to claim 7, in which each of the upstanding poles is provided with adjustable members for keeping a distance to wall structures.

9. A support structure according to claim 8, in which the height of each of the upstanding poles is adjustable.

10. A support structure according to claim 9, in which the telescopic rails comprise an inner rail section and an outer rail section, the outer rail section defining a first inner cavity, the inner rail section defining a second inner cavity, the inner rail section being at least partially disposed within the first cavity whereby the outer rail section embraces the inner rail section in a sliding engagement allowing the inner rail section to be telescopically displaceable in and out of the outer rail section, the outer rail section is provided with a longitudinally extending first opening through which the downward projection may extend, the inner rail section is provided with a longitudinally extending second opening through which the connecting member may extend, the outer rail section is provided with a first longitudinally extending interior support surface on both sides of the first longitudinally extending opening for guiding and supporting the lower set of wheels, and the inner rail section is provided with a second longitudinally extending interior support surface on both sides of the second longitudinally extending opening for guiding and supporting the upper set of wheels.

* * * * *